US010367276B2

(12) United States Patent
Wu et al.

(10) Patent No.: US 10,367,276 B2
(45) Date of Patent: Jul. 30, 2019

(54) CONDUCTIVE COMPONENT STRUCTURE OF WIRE CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Ming-Shan Tai, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/969,968

(22) Filed: May 3, 2018

(65) Prior Publication Data

US 2018/0323522 A1 Nov. 8, 2018

(30) Foreign Application Priority Data

May 8, 2017 (TW) ..... 106115117 A

(51) Int. Cl.

| | |
|---|---|
| ***H01R 9/24*** | (2006.01) |
| ***H01R 4/48*** | (2006.01) |
| ***H01R 9/22*** | (2006.01) |
| ***H01R 9/26*** | (2006.01) |

(52) U.S. Cl.

CPC ..... *H01R 9/2416* (2013.01); *H01R 4/4836* (2013.01); *H01R 9/223* (2013.01); *H01R 9/26* (2013.01); *H01R 9/2483* (2013.01)

(58) Field of Classification Search

CPC ..... H01R 9/2416; H01R 4/4836; H01R 9/23; H01R 9/26

USPC ..... 439/722

See application file for complete search history.

(56) References Cited

U.S. PATENT DOCUMENTS 3,622,941 A * 11/1971 Wetmore ..... H01R 4/726 411/909
4,142,771 A * 3/1979 Barnes ..... H01R 4/184 174/84 C
4,346,955 A * 8/1982 Chesnais ..... H01R 4/2445 439/407
4,397,514 A * 8/1983 Durand ..... H01R 4/4818 439/436
4,437,720 A * 3/1984 Harbauer ..... H01R 4/4827 439/435
4,699,441 A * 10/1987 D'Urso ..... H01R 4/2466 439/397

(Continued)

*Primary Examiner* — Alexander Gilman
(74) *Attorney, Agent, or Firm* — Rosenberg, Klein & Lee

(57) ABSTRACT

A conductive component structure of wire connection terminal is manufactured at lower cost and more securely assembled with the conductive wire. The conductive component includes a main body in the form of a plate body and a restriction body connected on the main body. The restriction body defines a mouth section and has an oblique wall connected with the mouth section. When the conductive wire is plugged into the case into contact with the conductive component, the restriction body guides the conductive wire and the rear end of the conductive wire is restricted and secured by the oblique wall. The conductive component improves the shortcomings of the conventional structure that the conductive wire is apt to deflect or swing due to external force to lead to unstable contact and insecurity and affect the electro-conductive efficiency.

32 Claims, 12 Drawing Sheets

(56) References Cited

U.S. PATENT DOCUMENTS 4,840,578 A * 6/1989 Sato ..... H01R 4/2425 439/395
4,889,501 A * 12/1989 Sato ..... H01R 13/422 439/595
4,940,425 A * 7/1990 Hass ..... H01R 4/2466 439/397
5,025,350 A * 6/1991 Tienken ..... B60Q 1/32 362/238
5,401,185 A * 3/1995 Wang ..... H01R 4/4818 439/441
5,427,545 A * 6/1995 Kourimsky ..... H01R 4/2466 439/397
5,860,829 A * 1/1999 Hower ..... H01R 4/2433 439/397
6,012,944 A * 1/2000 Hatakeyama ..... H01R 4/4818 439/441
6,146,186 A * 11/2000 Barrat ..... H01R 4/2416 439/410
6,152,760 A * 11/2000 Reeser ..... H01R 4/2433 439/395
6,319,046 B1 * 11/2001 Feye-Hohmann ... H01R 4/2433 439/395
6,336,824 B1 * 1/2002 Sorig ..... H01R 4/4836 439/395
6,478,605 B2 * 11/2002 Stuckmann ..... H01R 4/2429 439/395
6,488,526 B2 * 12/2002 Ruiz ..... B42F 7/065 439/406
6,500,020 B2 * 12/2002 Vo ..... H01R 4/2433 439/133
6,500,021 B2 * 12/2002 Wilmes ..... H01R 4/2433 439/395
7,544,103 B2 * 6/2009 Walter ..... H01R 4/4836 439/441
9,093,760 B2 * 7/2015 Weikle ..... H01R 4/2433
2003/0049961 A1 * 3/2003 Tricaud ..... H04Q 1/20 439/417

* cited by examiner

CONDUCTIVE COMPONENT STRUCTURE OF WIRE CONNECTION TERMINAL

BACKGROUND OF THE INVENTION

1. Field of the Invention

The present invention relates generally to a conductive component structure of wire connection terminal, and more particularly to a conductive component having a restriction body for guiding the conductive wire and helping in securing the conductive wire.

2. Description of the Related Art

A conventional terminal device or wire pressing terminal has an insulation case (generally made of plastic material), a metal component (or so-called electrical conductive component) and a leaf spring conductor (or so-called metal leaf spring). The metal component and the leaf spring conductor are enclosed in the insulation case to press and electrically connect with or release a conductive wire plugged in the terminal device.

Such electrical connection terminal devices include two types. The first type of electrical connection terminal device is inserted on a circuit board such as printed circuit board (PCB). The second type of electrical connection terminal device is latched with a grounding rail (or conductive rail) in a row to set up a common grounding device of an electrical apparatus or mechanical equipment for conducting out the residual voltage or static of the machine.

Such electrical connection terminal (or rail-type electrical connection terminal) generally includes an insulation case having a wire plug-in hole for the conductive wire to plug into the interior of the case. The case defines a chamber in which a conductive support (or conductive component) and metal leaf spring. The metal leaf spring and the conductive component serve to press the conductive wire plugged into the case and contact or electrically connect with the conductive wire. Unless an operator uses a tool to extend into the case and push/press the metal leaf spring, the conductive wire cannot be released from the electrical connection or contact with the metal leaf spring and the conductive component.

The assembling structure of the conventional electrical connection terminal has some shortcomings in manufacturing and operation application. For example, when a large-diameter conductive wire is plugged into the electrical connection terminal, it often takes place that the pressing force applied by the metal leaf spring and the conductive component to the conductive wire is insufficient so that the conductive wire can be hardly securely pressed and the conductive wire is apt to deflect or swing due to incautious touch of an operator. This will lead to poor contact and insecurity.

In order to improve the shortcomings of insufficient pressing force and electro-conductive insecurity or efficiency, a conventional electrical connection terminal has been disclosed, which employs a screw to lock and restrict the conductive wire or uses double-layer metal leaf spring or thickened metal leaf spring and conductive component to increase the pressing force for the conductive wire.

However, as well known by those who are skilled in this field, it is quite troublesome and time-costing to use a screw to lock and restrict or release the conductive wire. Also, the increase of the thickness of the metal leaf spring and the conductive component will lead to increase of the manufacturing cost and it is laborious to operate the thickened metal leaf spring and conductive component. This is not what we expect.

To speak representatively, the above reveals some shortcomings existing in the conventional wire connection terminal in structure assembly design and application. In case the structure assembly of the conductive component and the metal leaf spring or leaf spring conductor is redesigned to be different from the conventional wire connection terminal, the use form of the wire connection terminal can be changed to practically widen the application range thereof.

It is found that the structural form of an optimal terminal device or conductive component must overcome or improve the aforesaid shortcomings of the conventional wire connection terminal and include several design considerations as follows:

1. In condition that the thickness of the conductive component and/or the metal leaf spring is not increased, the cooperative structures of the conductive component and/or the metal leaf spring must be able to provide sufficient pressing force so that the wire connection terminal is applicable to a large-diameter conductive wire. Also, the conductive component and/or the metal leaf spring of the electrical connection terminal must overcome the shortcomings of the conventional electrical connection terminal that the pressing force applied by the metal leaf spring and the conductive component to the conductive wire is insufficient, the conductive wire can be hardly securely pressed and the conductive wire is apt to deflect or swing due to incautious touch of an operator to lead to poor contact and insecurity.
2. In addition, the conductive component and/or the metal leaf spring of the electrical connection terminal must be free from the screw of the conventional electrical connection terminal for locking and restricting the conductive wire and eliminate the shortcoming of the conventional electrical connection terminal that it is quite troublesome and time-costing to use the screw to lock and restrict or release the conductive wire. Also, the conductive component and/or the metal leaf spring of the electrical connection terminal must improve the shortcoming of the conventional electrical connection terminal that the thickness of the metal leaf spring and the conductive component is increased to lead to increase of the manufacturing cost and it is laborious to operate the thickened metal leaf spring and conductive component.
3. Moreover, the electrical connection terminal must provide a conductive component structure, which is able to help the metal leaf spring in pressing the conductive wire and is able to guide the conductive wire and help in fixing the conductive wire so as to minimize the possibility of deflection or swing of the conductive wire.

SUMMARY OF THE INVENTION

It is therefore a primary object of the present invention to provide a conductive component structure of wire connection terminal, which is manufactured at lower cost and more securely assembled with the conductive wire. The conductive component includes a main body in the form of a plate body and a restriction body connected on the main body. The restriction body defines a mouth section and has an oblique wall connected with the mouth section. When the conductive wire is plugged into the case into contact with the conductive component, the restriction body guides the conductive wire and the rear end of the conductive wire is restricted and secured by the oblique wall. The conductive component improves the shortcomings of the conventional structure that the conductive wire is apt to deflect or swing due to external force to lead to unstable contact and insecurity and affect the electro-conductive efficiency.

In the above conductive component structure of wire connection terminal, the oblique wall of the restriction body includes two lateral oblique walls and an upper oblique wall. The two lateral oblique walls obliquely extend from the mouth section in a direction away from the mouth section to respectively form an (elastic) free end. The free ends are gradually converged to get closer to each other to form a holding opening. The upper oblique wall obliquely extends from the mouth section in a direction away from the mouth section and toward the main body to form a rear end section. Therefore, after the conductive wire passes through the mouth section, the conductive wire is guided and elastically securely pressed and restricted by the lateral oblique walls (or the free ends) and/or the upper oblique wall (or the rear end sections), whereby the conductive component helps the metal leaf spring in pressing and restricting the conductive wire.

In the above conductive component structure of wire connection terminal, the oblique wall of the restriction body has a first section connected with the main body and a second section obliquely extending in a direction away from the main body. At least two sides of the second section are arched toward the main body to form two arched edges, whereby the second section is formed as a structure with a substantially C-shaped cross section to define the mouth section. Therefore, after the conductive wire passes through the mouth section, the conductive wire is guided by the oblique wall (or the first and second sections) and elastically securely pressed and restricted by the first section, whereby the conductive component helps the metal leaf spring in pressing and restricting the conductive wire.

In the above conductive component structure of wire connection terminal, the metal leaf spring includes a first leaf spring and a second leaf spring. Each of the first and second leaf springs having a head section, a bight section connected with the head section and a tail section connected with the bight section. The tail sections of the first and second leaf springs are respectively formed with a bent section. When the metal leaf spring is mounted in the case of the terminal, the head section and bight section of the first leaf spring are overlapped with or overlaid on the head section and bight section of the second leaf spring, while the tail section of the first leaf spring is separated from the tail section of the second leaf spring. Therefore, the tail section of the first leaf spring and the tail section of the second leaf spring respectively form a pressing point against the conductive wire, whereby the oblique wall of the restriction body cooperates with the first and second leaf springs to press and restrict the conductive wire to set up a multipoint system for fixing the conductive wire. Accordingly, the possibility of deflection or swing of the conductive wire due to collision of external force or assembling process is minimized.

The present invention can be best understood through the following description and accompanying drawings, wherein:

DETAILED DESCRIPTION OF THE PREFERRED EMBODIMENTS

Figure 1:
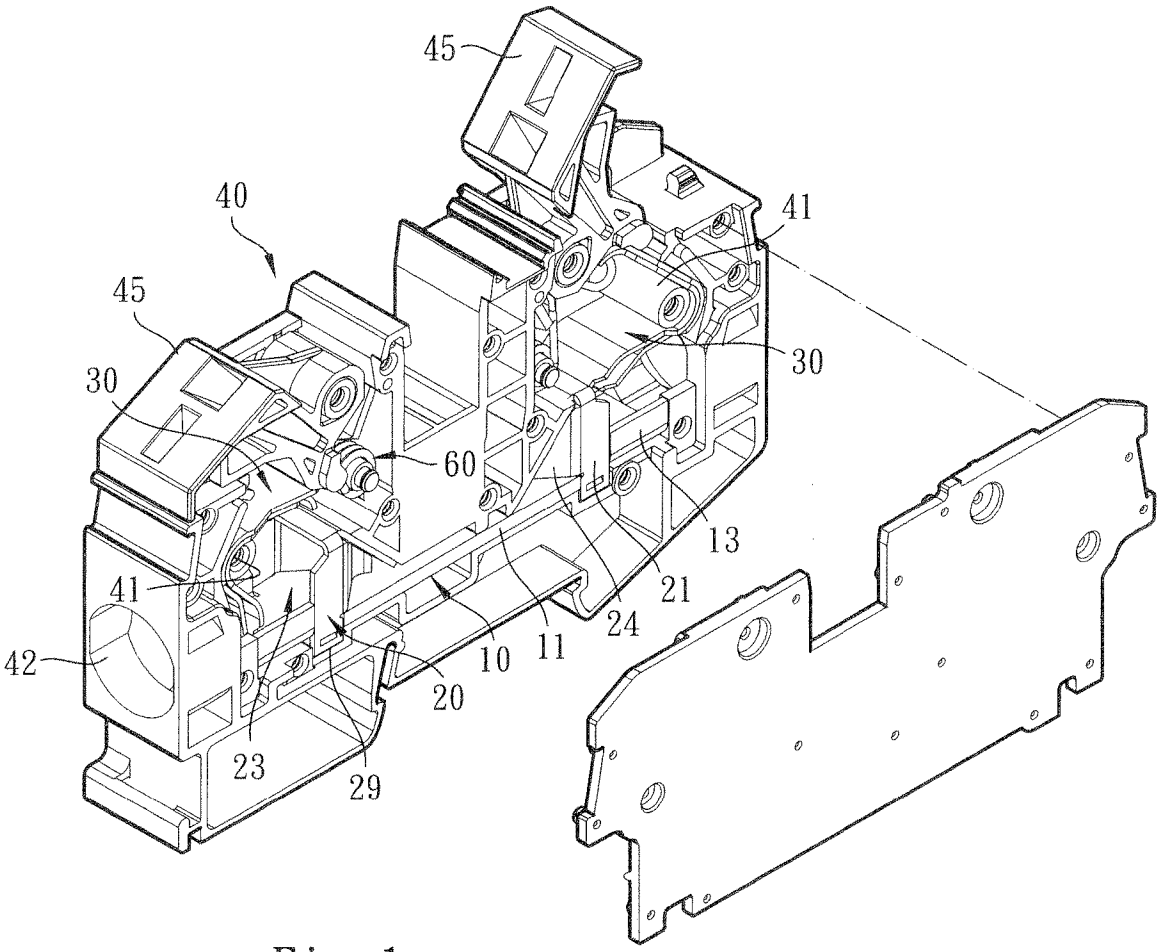
FIG. 1 is a perspective view of the assembly of the conductive component and the case of the present invention.
Figure 2:
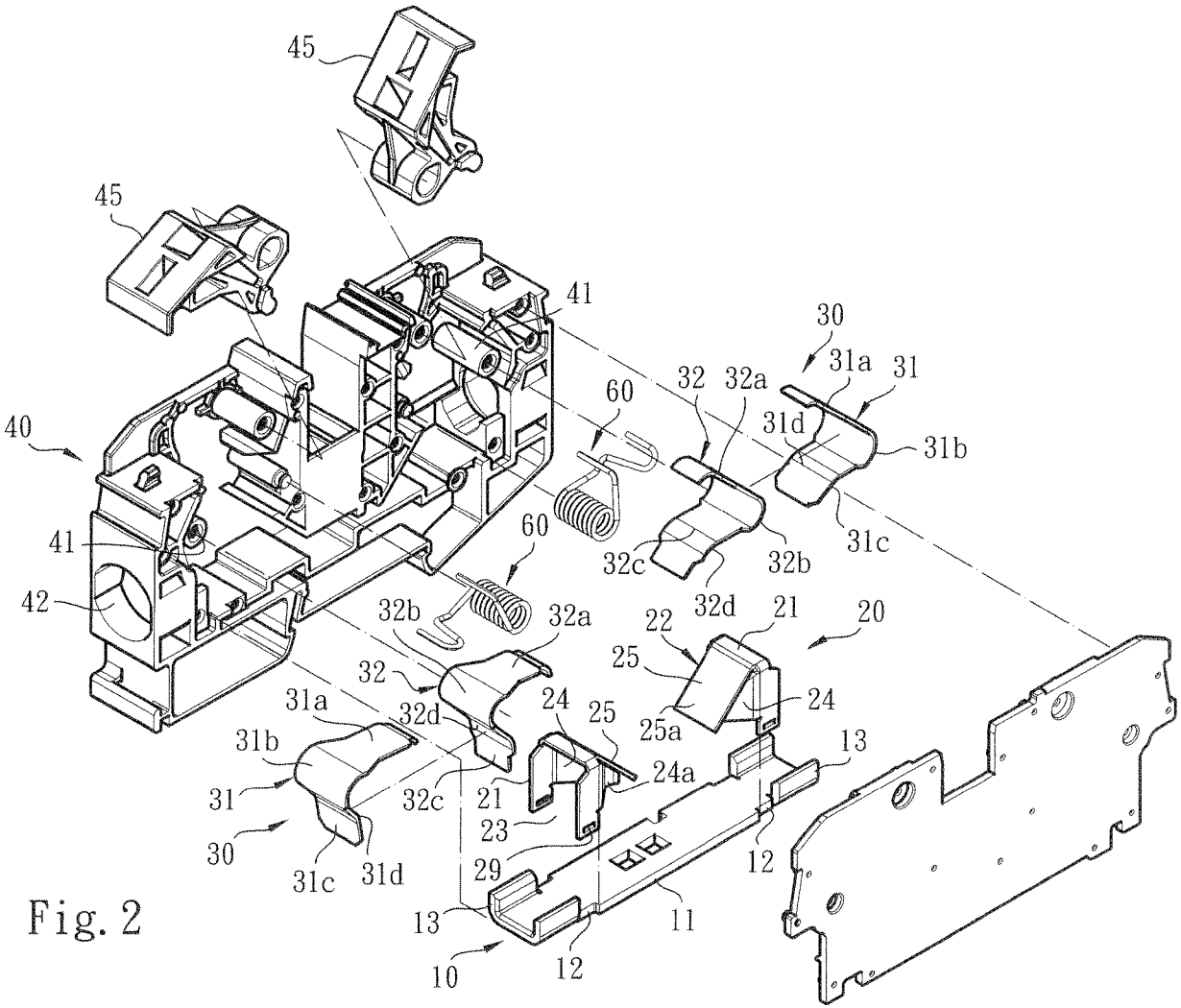
FIG. 2 is a perspective exploded view according to FIG. 1, showing the structures of the conductive component and the metal leaf spring.
Figure 3:
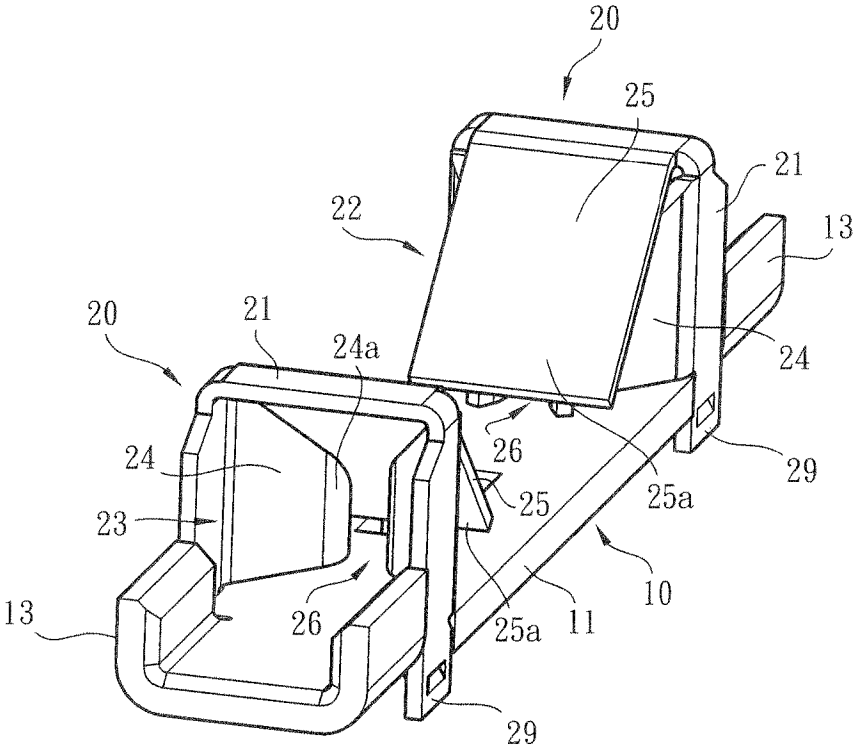
FIG. 3 is a perspective view of the conductive component of the present invention.

Please refer to FIGS. 1, 2 and 3. The conductive component structure of the wire connection terminal of the present invention includes an assembly of a main body 10 and a restriction body 20. The conductive component (or the main body 10 and the restriction body 20) in cooperation with metal leaf springs 30 and springs 60 is mounted in a case 40 made of insulation material to form the wire connection terminal.

The upper section, upper side, lower section, lower side, lateral side and bottom side mentioned hereinafter are recited with the direction of the drawings as the reference direction.

Figure 4:
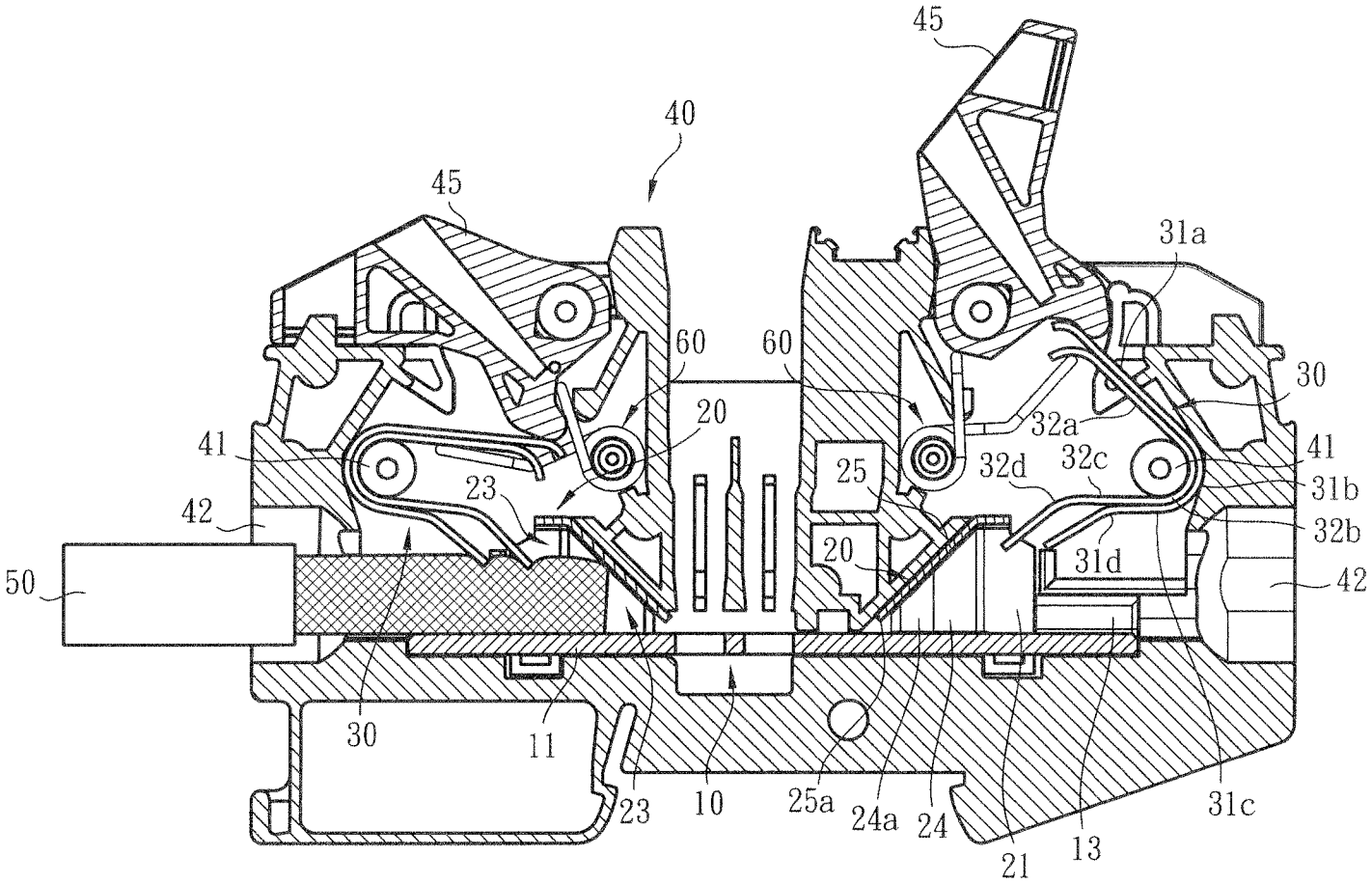
FIG. 4 is a sectional view showing the operation of the conductive component of the present invention, in which the conductive component and the metal leaf spring securely press and restrict the conductive wire.

In a preferred embodiment, the main body 10 is selectively made of an electro-conductive material in the form of a plate body. The restriction body 20 is selectively made of an electro-conductive material (or metal material) with hardness greater than the hardness of the main body 10. The restriction body 20 can be integrally formed or assembled/disposed on the main body 10. Two end sections of the main body 10 are formed with bent edges 13 upward extending from the lateral sides 11, whereby the two end sections of the main body 10 are formed as a structure with a U-shaped cross section. The bend edges 13 or the structure with the U-shaped cross section serve to help in guiding a conductive wire 50 into the conductive component (as shown in FIG. 4).

Also, when the conductive wire 50 is plugged into the case 40, the conductive component (or the restriction body 20) serves to prevent the conductive wire 50 from thrusting, cutting or scraping the case 40.

As shown in the drawings, the restriction body 20 includes a (reverse U-shaped) door plate 21 and an oblique wall 22. The door plate 21 has leg sections 29 securely connected with the lateral sides 11 of the main body 10 (or with the insertion notches 12 of the lateral sides 11) to define a mouth section 23. The oblique wall 22 is connected with the door plate 21 (or the mouth section 23).

As shown in FIGS. 2 and 3, the oblique wall 22 of the restriction body 20 includes two lateral oblique walls 24 and an upper oblique wall 25. The two lateral oblique walls 24 are connected with the door plate 21 (or the mouth section 23) and obliquely extend in a direction away from the door plate 21 (or the mouth section 23) to respectively form an (elastic) free end 24*a*. The free ends 24*a* are gradually converged to get closer to each other to form a holding opening 26. The upper oblique wall 25 is connected with the door plate 21 (or the mouth section 23) and obliquely extends in a direction away from the door plate 21 (or the mouth section 23) and toward the main body 10 to form a rear end section 25*a*.

In this embodiment, the metal leaf spring 30 includes a first leaf spring 31 and a second leaf spring 32. Each of the first and second leaf springs 31, 32 has a head section 31*a*, 32*a*, a bight section 31*b*, 32*b* connected with the head section 31*a*, 32*a* and a tail section 31*c*, 32*c* connected with the bight section 31*b*, 32*b*. The length of the tail section 31*c* of the first leaf spring 31 is smaller than the length of the tail section 32*c* of the second leaf spring 32. The tail sections 31*c*, 32*c* of the first and second leaf springs 31, 32 are respectively formed with a bent section 31*d*, 32*d*.

It should be noted that the contained angle of the bent section 31*d* of the tail section 31*c* of the first leaf spring 31 can be equal to or different from the contained angle of the bent section 32*d* of the tail section 32*c* of the second leaf spring 32 so as to control or adjust the position where the tail sections 31*c*, 32*c* press and restrict the conductive wire 50.

Please now refer to FIG. 4. The metal leaf spring 30 is mounted on a stake 41 of the case 40. The head section 31*a* and the bight section 31*b* of the first leaf spring 31 are overlapped with or overlaid on the head section 32*a* and the bight section 32*b* of the second leaf spring 32, while the tail section 31*c* of the first leaf spring 31 is separated from the tail section 32*c* of the second leaf spring 32.

As shown in the drawings, the tail section 32*c* of the second leaf spring 32 and/or the tail section 31*c* of the first leaf spring 31 can partially extend into the restriction body 20. This helps in positioning the metal leaf spring 30 to move in the right path.

As shown in FIG. 4, when the conductive wire 50 is plugged through the wire plug-in hole 42 of the case 40 into the case 40, the bent edges 13 of the main body 10 serve to guide the conductive wire 50 to pass through the mouth section 23 along the main body 10 to be guided and elastically securely pressed and restricted by the lateral oblique walls 24 (or the free ends 24*a*) and/or the upper oblique wall 25 (or the rear end section 25*a*). A shift member 45 disposed in the case 40 cooperatively presses down the metal leaf spring 30, whereby the conductive component serves to help the metal leaf spring 30 in pressing and restricting the conductive wire 50.

As shown in the drawings, the tail section 31*c* of the first leaf spring 31 and the tail section 32*c* of the second leaf spring 32 can respectively form a pressing point against the conductive wire 50. The oblique wall 22 of the restriction body 20 cooperatively presses and restricts the conductive wire 50, whereby a multipoint system for fixing the conductive wire 50 is set up. Accordingly, the possibility of deflection or swing of the conductive wire due to collision of external force or assembling process is minimized.

In some applications, after the conductive wire 50 passes through the mouth section 23, the rear end of the conductive wire 50 will be elastically securely pressed and restricted by the holding opening 26 defined by the lateral oblique walls 24.

Figure 5:
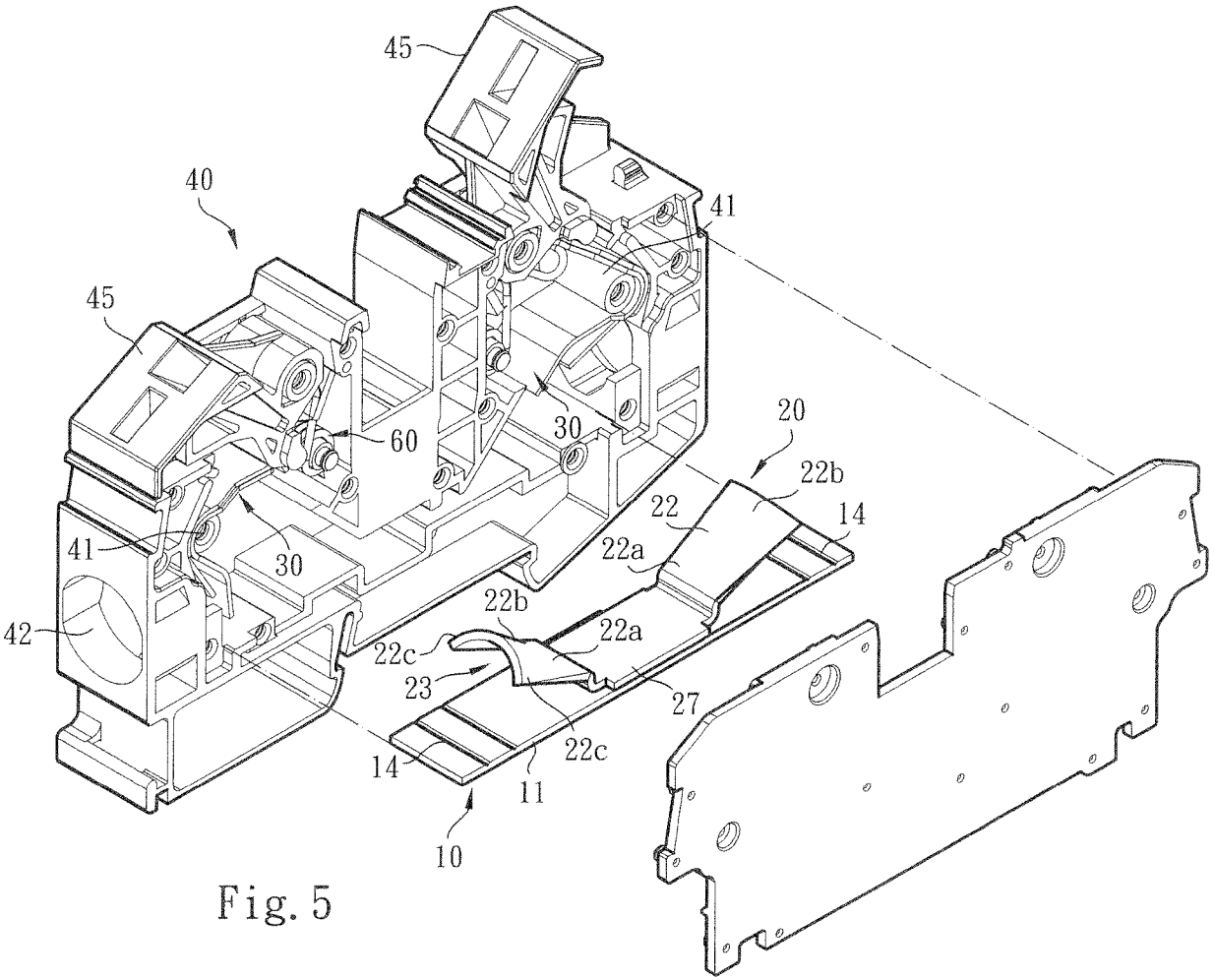
FIG. 5 is a perspective view of a modified embodiment of the present invention.
Figure 6:
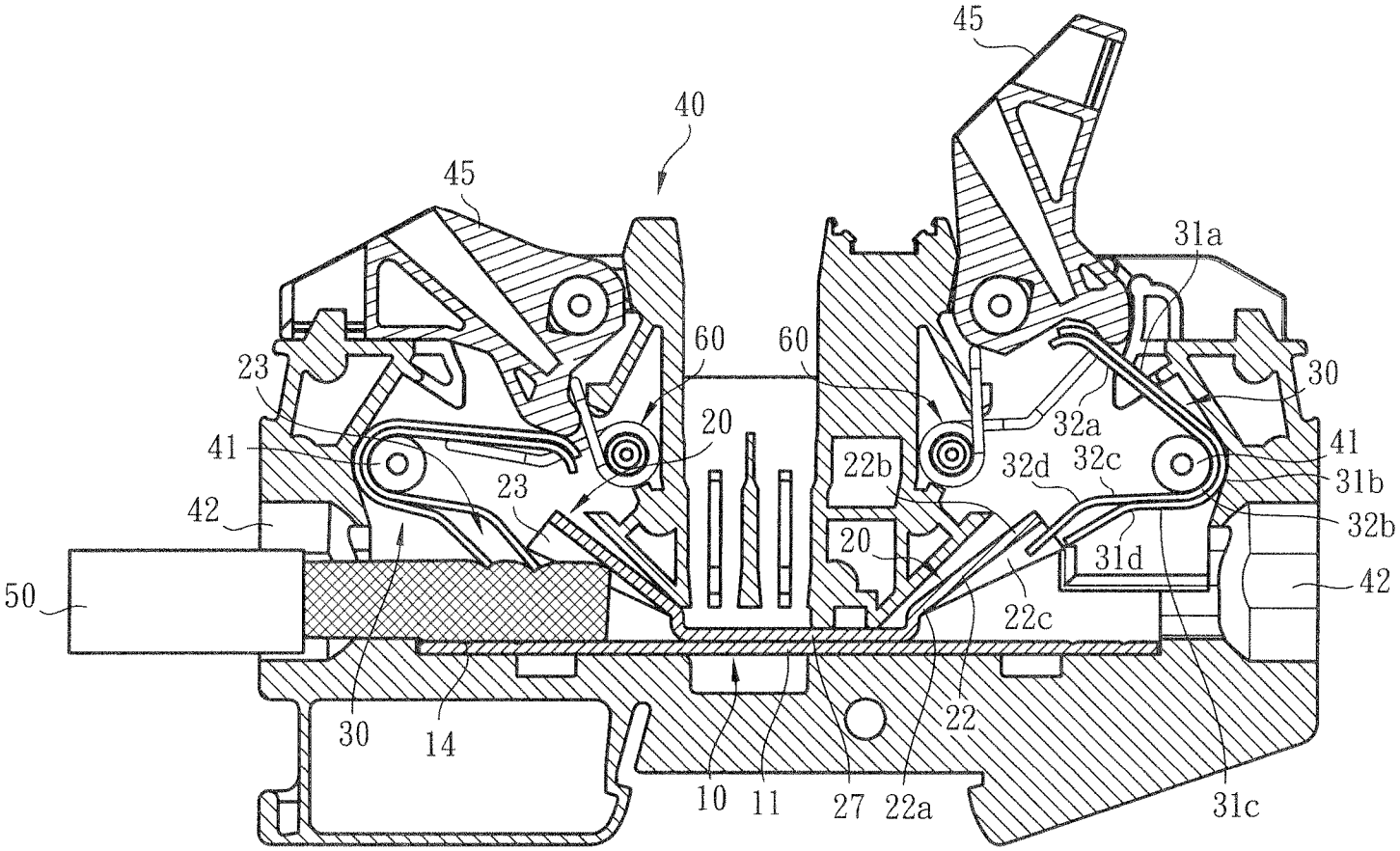
FIG. 6 is a sectional view showing the operation of the conductive component of FIG. 5, in which the conductive component and the metal leaf spring securely press and restrict the conductive wire.

Please now refer to FIGS. 5 and 6. In a modified embodiment of the conductive component, two end sections of the main body 10 are formed with multiple channels 14 to enhance the stability of the conductive wire 50 in contact with the conductive component. In addition, the oblique wall 22 of the restriction body 20 has a first section 22*a* connected with the main body 10 and a second section 22*b* obliquely extending in a direction away from the main body 10. At least two sides of the second section 22*b* (and/or the first section 22*a*) are arched toward the main body 10 to form two arched edges 22*c*, whereby the second section 22*b* is formed as a structure with a substantially C-shaped cross section to define the mouth section 23. The mouth section 23 is directed to two ends of the main body 10 (or the wire plug-in holes 42).

In this embodiment, the restriction body 20 and the main body 10 are selectively made of the same electro-conductive material to increase the contact area between the conductive component and the conductive wire 50 and enhance the electro-conductive efficiency. The restrict ion body 20 includes two oblique walls 22. Abase section 27 is connected between the first sections 22*a* of the two oblique walls 22. The base section 27 is overlaid on the main body 10.

As shown in FIG. 6, after the conductive wire 50 passes through the mouth section 23, the conductive wire 50 is guided by the oblique wall 22 (or the second section 22*b* and the first section 22*a*) and elastically securely pressed and restricted by the first section 22*a*. Accordingly, the oblique wall 22 serves to help the metal leaf spring 30 in pressing and restricting the conductive wire 50, whereby the oblique wall 22 and the metal leaf spring 30 cooperatively set up a multipoint system for fixing the conductive wire 50.

Figure 7:
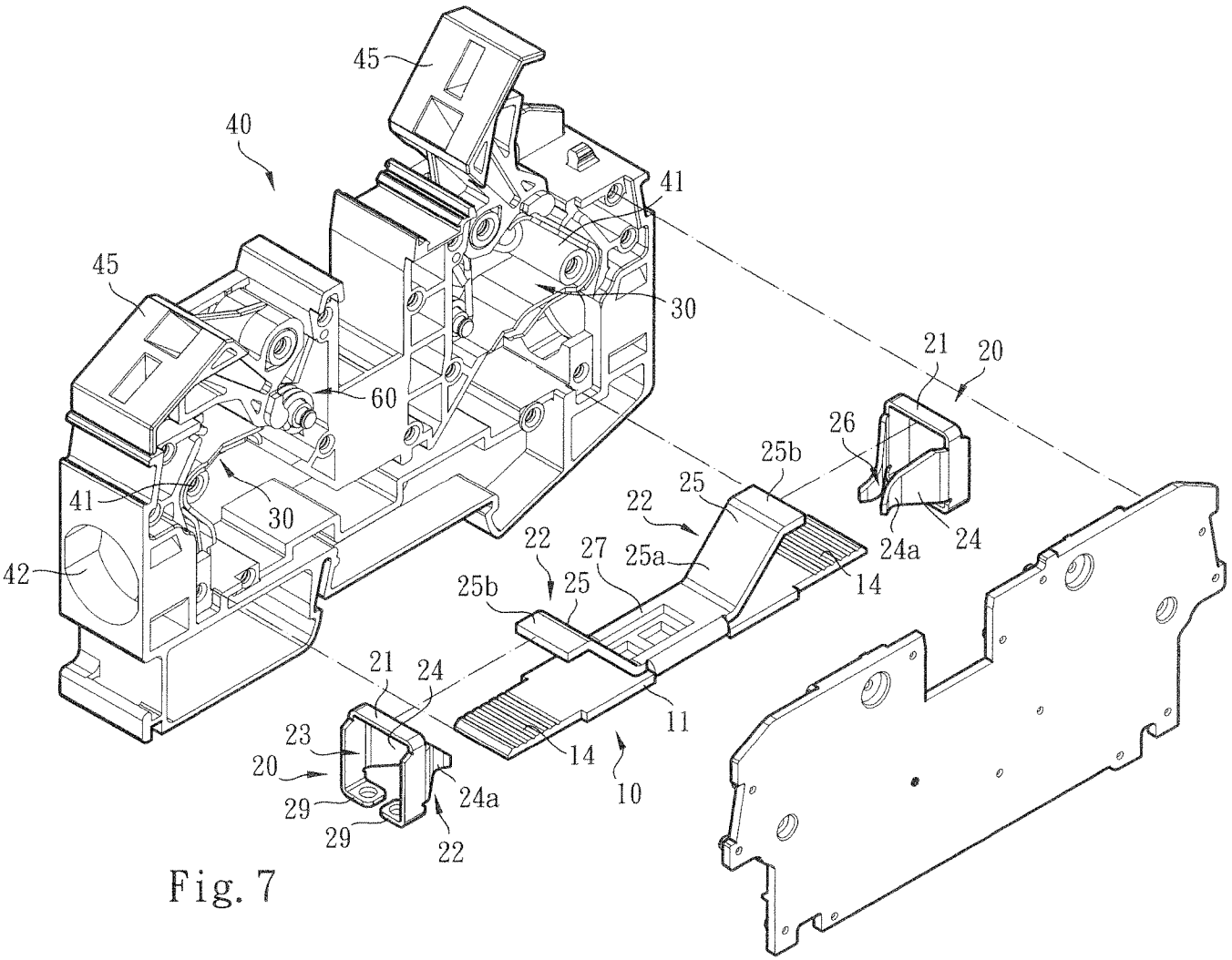
FIG. 7 is a perspective view of a preferred embodiment of the present invention.
Figure 8:
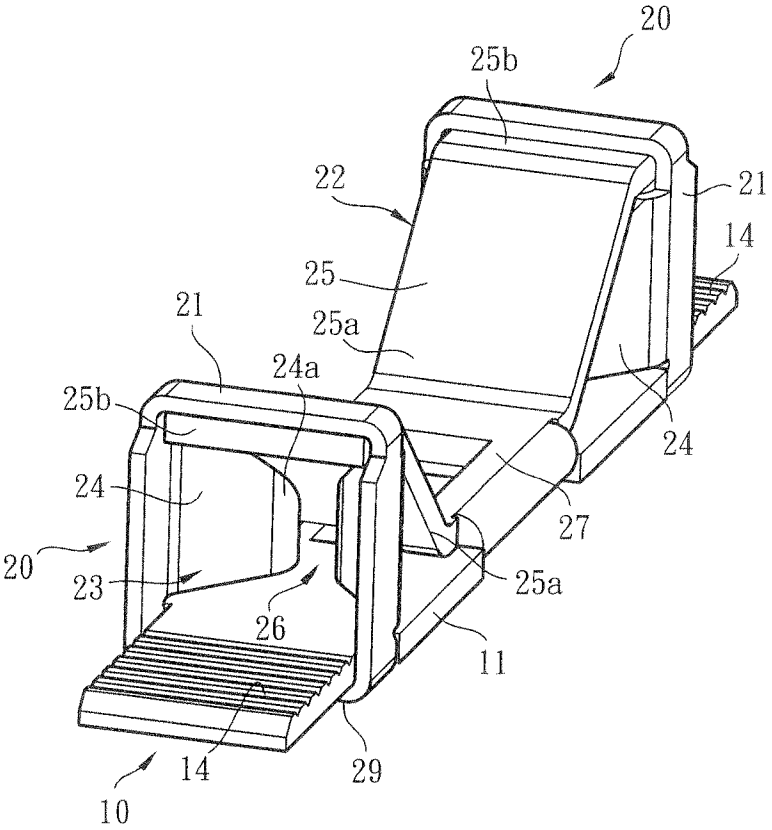
FIG. 8 is a perspective view of the conductive component of FIG. 7.
Figure 9:
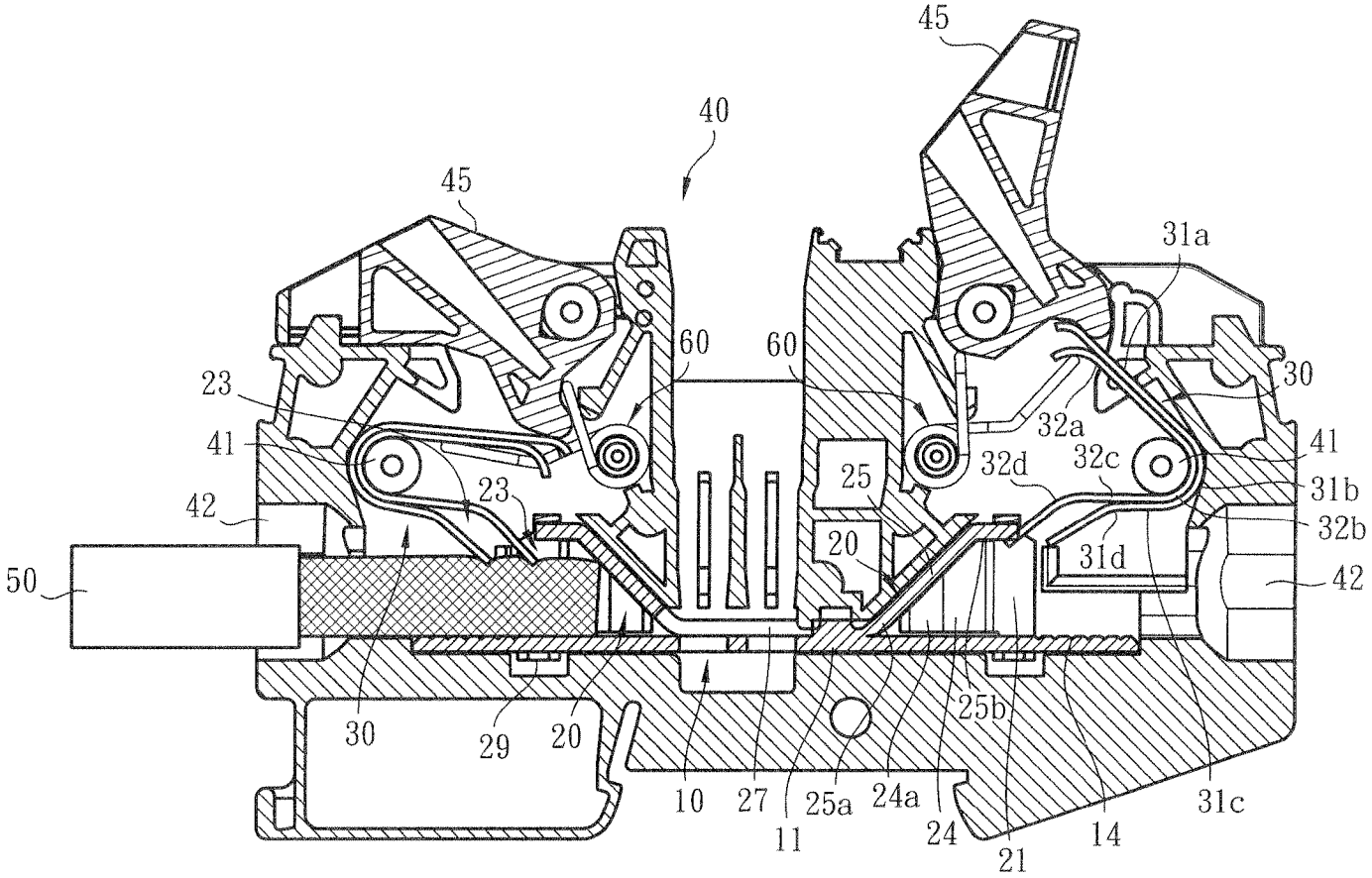
FIG. 9 is a sectional view showing the operation of the conductive component of FIG. 7, in which the conductive component and the metal leaf spring securely press and restrict the conductive wire.

Please now refer to FIGS. 7, 8 and 9. In a preferred embodiment of the conductive component, the restriction body 20 includes a (U-shaped) door plate 21 and an oblique wall 22. The door plate 21 has (bent) leg sections 29 securely connected with the lateral sides 11 (or the bottom side) of the main body 10 to define a mouth section 23. The oblique wall 22 is connected with the door plate 21 (or the mouth section 23).

As shown in FIGS. 7 and 8, the oblique wall 22 of the restriction body 20 includes two lateral oblique walls 24 and an upper oblique wall 25. The upper oblique wall 25 can be integrally formed on the main body 10. The two lateral oblique walls 24 are connected with the door plate 21 (or the mouth section 23) and obliquely extend in a direction away from the door plate 21 (or the mouth section 23) to respectively form an (elastic) free end 24*a*. The free ends 24*a* are gradually converged to get closer to each other to form a holding opening 26. The upper oblique wall 25 has a rear end section 25*a* and subsidiary end section 25*b*. The subsidiary end section 25*b* is connected with the door plate 21 (or the mouth section 23). The rear end section 25*a* obliquely extends in a direction away from the door plate 21 (or the mouth section 23) and toward the main body 10.

In this embodiment, the conductive component has two restriction bodies 20. Therefore, a base section 27 is connected between the rear end sections 25*a* of the upper oblique walls 25 of the two restriction bodies 20. The base section 27 is overlaid on the main body 10. The upper oblique walls 25, the base section 27 and the main body 10 are selectively made of the same electro-conductive material to increase the contact area between the conductive component and the conductive wire 50 and enhance the electro-conductive efficiency. The door plates 21 and the lateral oblique walls 24 of the restriction bodies 20 are selectively made of a material with hardness greater than the hardness of the main body 10.

As shown in FIG. 9, after the conductive wire 50 is plugged into the case 40 through the wire plug-in hole 42 thereof, the conductive wire 50 passes through the mouth section 23 along the main body 10. Then the conductive wire 50 is guided and elastically securely pressed and restricted by the lateral oblique walls 24 (or the free ends 24*a*) and/or the upper oblique wall 25 (or the rear end sections 25*a*). The shift member 45 disposed in the case 40 cooperatively presses down the metal leaf spring 30, whereby the conductive component serves to help the metal leaf spring 30 in pressing and restricting the conductive wire 50.

As shown in the drawings, the tail section 31*c* of the first leaf spring 31 and the tail section 32*c* of the second leaf spring 32 can respectively form a pressing point against the conductive wire 50. The oblique wall 22 of the restriction body 20 and/or the holding opening 26 cooperatively presses and restricts the conductive wire 50, whereby a multipoint system for fixing the conductive wire 50 is set up.

Figure 10:
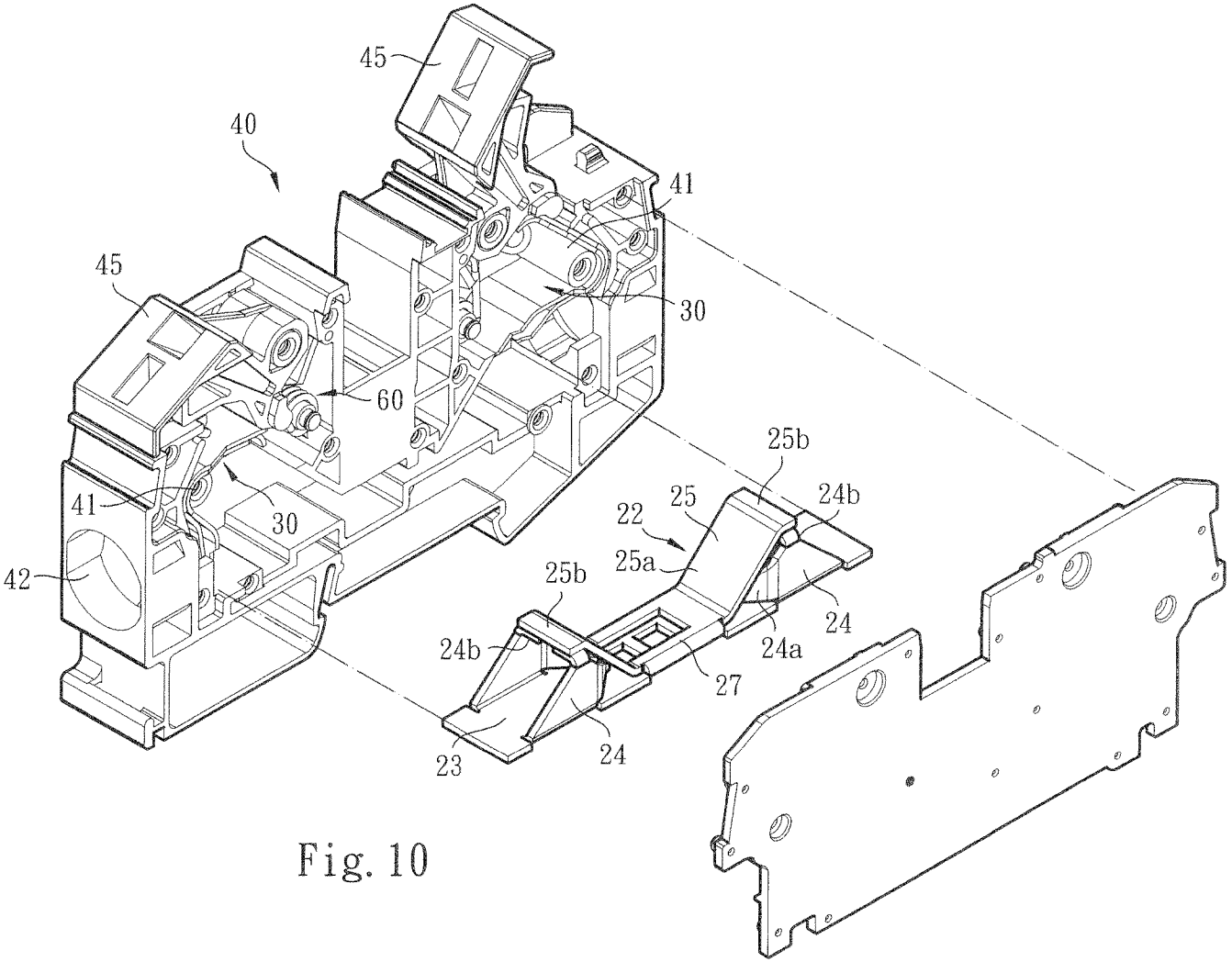
FIG. 10 is a perspective view of a modified embodiment of the present invent ion.
Figure 11:
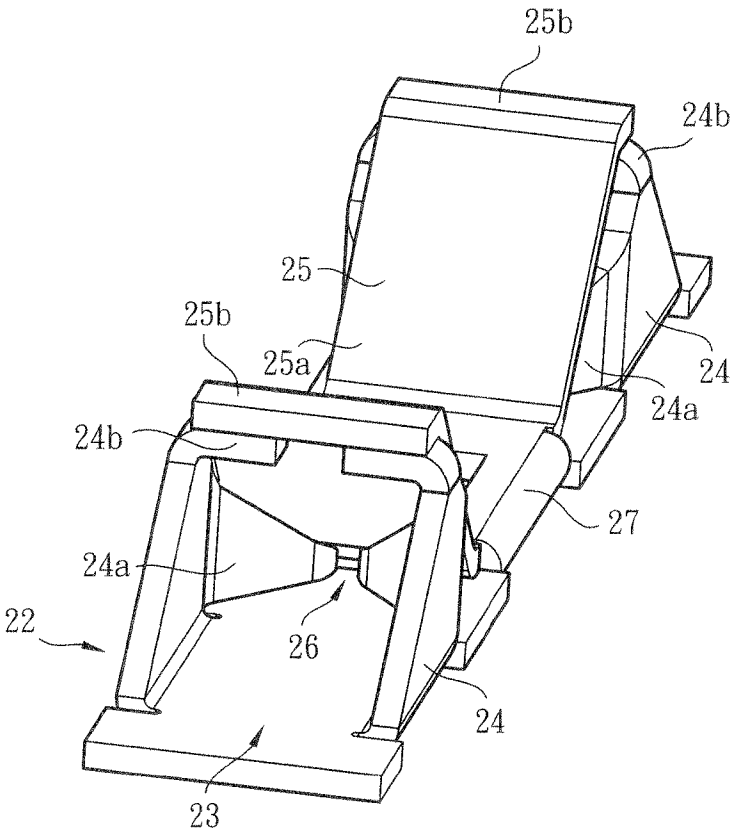
FIG. 11 is a perspective view of the conductive component of FIG. 10.
Figure 12:
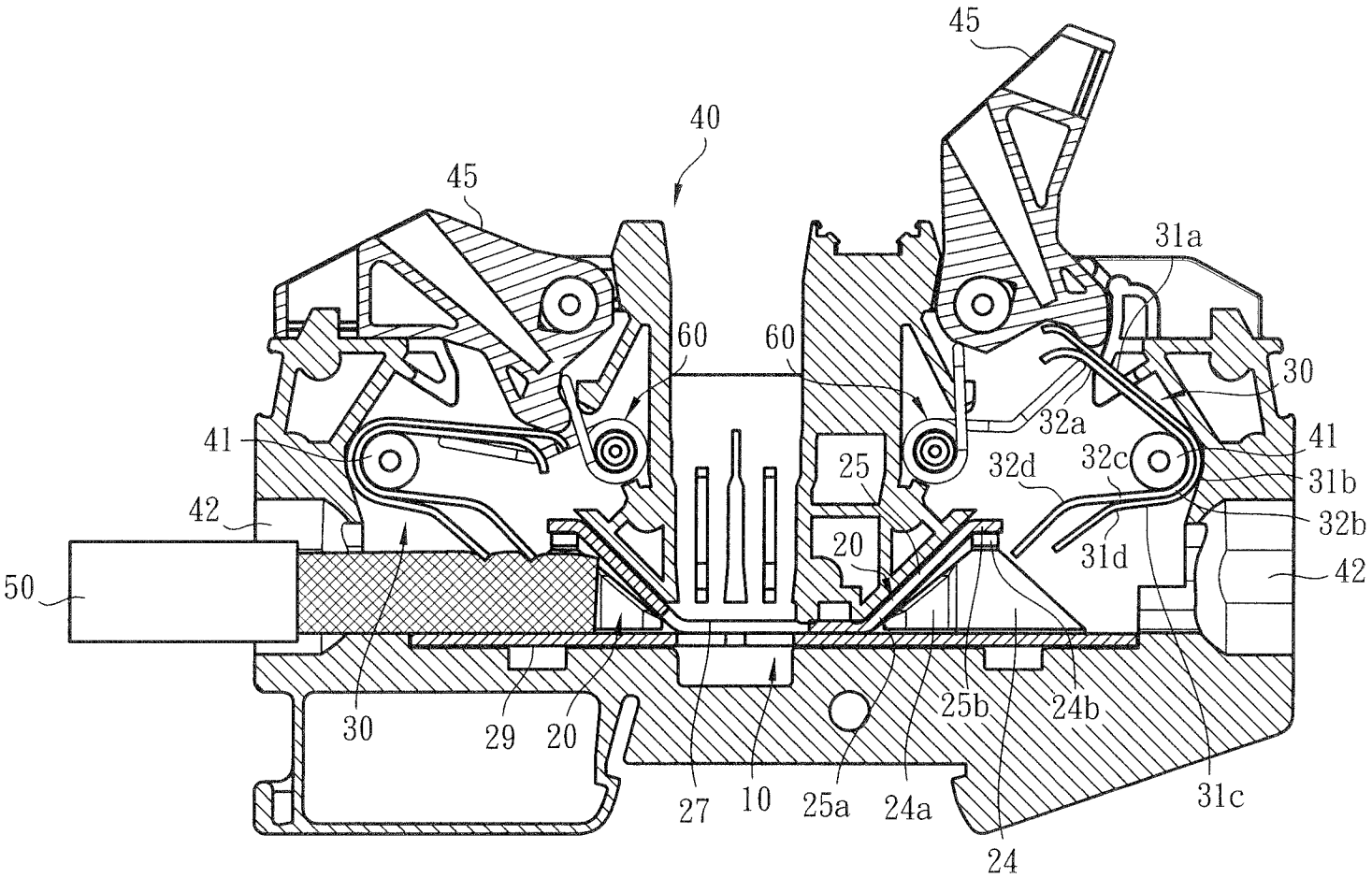
FIG. 12 is a sectional view showing the operation of the conductive component of FIG. 10, in which the conductive component and the metal leaf spring securely press and restrict the conductive wire.

Please now refer to FIGS. 10, 11 and 12. In a modified embodiment of the conductive component, the restriction body 20 is integrally formed on the main body 10 (or formed by means of bending the main body 10). The restriction body 20 has an oblique wall 22. The oblique wall 22 includes two lateral oblique walls 24 and an upper oblique wall 25. The two lateral oblique walls 24 are bent from two lateral sides 11 of the main body 10 to the upper side of the drawing and (perpendicularly) protrude from the lateral sides 11 of the main body 10. The two lateral oblique walls 24 define a geometrical configuration (such as a triangular configuration). As shown in the drawings, the top ends of the lateral oblique walls 24 are oppositely bent toward each other to form brow sections 24*b*. The brow sections 24*b*, the lateral oblique walls 24 (and/or the main body 10) together define the mouth section 23.

As shown in FIGS. 10 and 11, the two lateral oblique walls 24 obliquely extend in a direction away from the mouth section 23 to respectively form an (elastic) free end 24*a*. The free ends 24*a* are gradually converged to get closer to each other to form a holding opening 26. The upper oblique wall 25 has a rear end section 25*a* and subsidiary end section 25*b*. The subsidiary end section 25*b* is in contact with the brow sections 24*b*. The rear end section 25*a* obliquely extends in a direction away from the brow sections 24*b* (or the mouth section 23) and toward the main body 10.

In this embodiment, the conductive component has two restriction bodies 20. Therefore, a base section 27 is connected between the rear end sections 25*a* of the upper oblique walls 25 of the two restriction bodies 20. The base section 27 is integrally formed on the main body 10 (or formed by means of bending the main body 10). The base section 27 is overlaid on the main body 10. The restriction bodies 20, the base section 27 and the main body 10 are selectively made of the same electro-conductive material to increase the contact area between the conductive component and the conductive wire 50 and enhance the electro-conductive efficiency.

As shown in FIG. 12, after the conductive wire 50 is plugged into the case 40 through the wire plug-in hole 42 thereof, the conductive wire 50 passes through the mouth section 23 along the main body 10. Then the conductive wire 50 is guided and elastically securely pressed and restricted by the lateral oblique walls 24 (or the free ends 24*a*) and/or the upper oblique wall 25 (or the rear end sections 25*a*). The shift member 45 disposed in the case 40 cooperatively presses down the metal leaf spring 30, whereby the conductive component serves to help the metal leaf spring 30 in pressing and restricting the conductive wire 50.

To speak representatively, in comparison with the conventional wire connection terminal, the conductive component structure of the wire connection terminal of the present invention has the following advantages:

1. The main body 10, the restriction body 20 and the metal leaf spring 30 of the conductive component and the relevant components and structures have been redesigned. For example, the restriction body 20 includes a mouth section 23 (and/or a door plate 21) and an oblique wall 22. The oblique wall 22 includes two lateral oblique walls 24 connected with the mouth section 23 and an upper oblique wall 25. The two lateral oblique walls 24 form a holding opening 26. The rear end section 25*a* of the upper oblique wall 25 is connected with the base section 27. The second section 22*b* of the oblique wall 22 is formed with the bent edge 22*c*. Each of the first and second leaf springs 31, 32 has a tail section 31*c*, 32*c*, and the tail sections 31*c*, 32*c* of the first and second leaf springs 31, 32 are respectively formed with a bent section 31*d*, 32*d*. The contained angle of the bent section 31*d* of the tail section 31*c* of the first leaf spring 31 can be equal to or different from the contained angle of the bent section 32*d* of the tail section 32*c* of the second leaf spring 32. The present invention is obviously different from the conventional wire connection terminal in use and operation form. Also, the present invention changes the electro-conductive structure or assembling relationship of the conventional terminal device.
2. The oblique wall 22 (and/or the holding opening 26) of the restriction body 20 cooperates with the metal leaf spring 30 to form a multipoint system for fixing the conductive wire 50. Therefore, in condition that the thickness of the conductive component and/or the metal leaf spring is not increased, the conductive component and/or the metal leaf spring can provide sufficient pressing force so that the wire connection terminal is applicable to a large-diameter conductive wire. The present invention improves the shortcomings of the conventional structure that the pressing force applied to the conductive wire is insufficient and the conductive wire can be hardly securely pressed and restricted so that the electro-conductive efficiency is affected. Also, the present invention improves the shortcomings of the conventional structure that the conductive wire is apt to deflect or swing (due to incautious touch of an operator or the assembling process) to lead to poor contact and insecurity. Especially, the conductive component provides a structure capable of guiding the conductive wire 50 to plug through the wire plug-in hole 42 into the case 40 and helping the metal leaf spring 30 in securely pressing and restricting the conductive wire 50. The present invention obviously improves the shortcoming of the conventional structure that it is quite troublesome and time-costing to use the screw to lock and restrict the conductive wire. Also, the present invention obviously improves the shortcomings of the conventional structure that the thickness of the metal leaf spring and the conductive component is increased to lead to increase of the manufacturing cost and it is laborious to operate the thickened metal leaf spring and conductive component.

In conclusion, the conductive component structure of the wire connection terminal of the present invention is different from the conventional terminal device in space form and is advantageous over the conventional wire connection terminal. The conductive component structure of the wire connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. A conductive component structure of wire connection terminal, comprising:

a main body made of an electro-conductive material in the form of a plate body; and a restriction body integrally formed on the main body or assembled/disposed on the main body, the restriction body defining a mouth section and having an oblique wall connected with the mouth section, the oblique wall extending from the mouth section to form a securing section in combination with the main body, the securing section narrowing both horizontally and vertically from the mouth section to thereby guide and secure a conductive wire plugged into the wire connection terminal.

2. The conductive component structure of wire connection terminal as claimed in claim 1, wherein the oblique wall of the restriction body includes two lateral oblique walls and an upper oblique wall, the two lateral oblique walls being connected with the mouth section and obliquely extending in a direction away from the mouth section to respectively form a free end, the free ends being gradually converged to get closer to each other to form a holding opening, the upper oblique wall being connected with the mouth section and obliquely extending in a direction away from the mouth section and toward the main body to form a rear end section, the restriction body having a hardness greater than a hardness of the main body, two end sections of the main body being formed with bent edges upward extending from the lateral sides of the main body, whereby the two end sections of the main body are formed as a structure with a U-shaped cross section.

3. The conductive component structure of wire connection terminal as claimed in claim 1, wherein two end sections of the main body are formed with multiple channels, the oblique wall of the restriction body having a first section connected with the main body and a second section obliquely extending in a direction away from the main body, at least two sides of the second section being arched toward the main body to form two arched edges, the second section being thereby formed as a structure with a substantially C-shaped cross section to define the mouth section, a concave side of the second section substantially facing the main body.

4. The conductive component structure of wire connection terminal as claimed in claim 3, wherein the main body and the restriction body are made of the same electro-conductive material and disposed in the case, the case being assembled with the metal leaf spring, the restriction body including two oblique walls, a base section being connected between the first sections of the two oblique walls, the base section being overlaid on the main body, whereby the first sections of the oblique walls can elastically securely press and restrict the conductive wire.

5. The conductive component structure of wire connection terminal as claimed in claim 4, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

6. The conductive component structure of wire connection terminal as claimed in claim 1, wherein the restriction body is integrally formed on the main body, the oblique wall including two lateral oblique walls and an upper oblique wall, the two lateral oblique walls being upward bent from two lateral sides of the main body and protruding from the lateral sides of the main body, the two lateral oblique walls defining a geometrical configuration, top ends of the lateral oblique walls being oppositely bent toward each other to form brow sections, the brow sections, the lateral oblique walls and the main body together defining the mouth section, the two lateral oblique walls obliquely extending in a direction away from the mouth section to respectively form a free end, the free ends being gradually converged to get closer to each other to form a holding opening, the upper oblique wall having a rear end section and a subsidiary end section, the subsidiary end section being in contact with the brow sections, the rear end section obliquely extending in a direction away from the brow sections and toward the main body.

7. The conductive component structure of wire connection terminal as claimed in claim 6, wherein the main body and the restriction body are made of the same electro-conductive material and disposed in the case, the case being assembled with the metal leaf spring, the conductive component having two restriction bodies, a base section being connected between the rear end sections of the upper oblique walls of the two restriction bodies, the base section being integrally formed on the main body and overlaid on the main body.

8. The conductive component structure of wire connection terminal as claimed in claim 7, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

9. The conductive component structure of wire connection terminal as claimed in claim 1, wherein the main body and the restriction body are mounted in a case in cooperation with a metal leaf spring.

10. The conductive component structure of wire connection terminal as claimed in claim 9, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

11. The conductive component structure of wire connection terminal as claimed in claim 9, wherein the oblique wall of the restriction body includes two lateral oblique walls and an upper oblique wall, the two lateral oblique walls being connected with the door plate and obliquely extending in a direction away from the door plate to respectively form a free end, the free ends being gradually converged to get closer to each other to form a holding opening, the upper oblique wall being connected with the door plate and obliquely extending in a direction away from the door plate and toward the main body to form a rear end section, the restriction body having a hardness greater than a hardness of the main body, two end sections of the main body being formed with bent edges upward extending from the lateral sides of the main body, whereby the two end sections of the main body are formed as a structure with a U-shaped cross section.

12. The conductive component structure of wire connection terminal as claimed in claim 11, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

13. The conductive component structure of wire connection terminal as claimed in claim 1, wherein the restriction body includes a door plate defining the mouth section and being connected with the oblique wall, the door plate having leg sections securely connected with lateral sides or a bottom side of the main body.

14. The conductive component structure of wire connection terminal as claimed in claim 13, wherein the oblique wall of the restriction body includes two lateral oblique walls and an upper oblique wall, the two lateral oblique walls being connected with the mouth section and obliquely extending in a direction away from the mouth section to respectively form a free end, the free ends being gradually converged to get closer to each other to form a holding opening, the upper oblique wall being connected with the mouth section and obliquely extending in a direction away from the mouth section and toward the main body to form a rear end section, the restriction body having a hardness greater than a hardness of the main body, two end sections of the main body being formed with bent edges upward extending from the lateral sides of the main body, whereby the two end sections of the main body are formed as a structure with a U-shaped cross section.

15. The conductive component structure of wire connection terminal as claimed in claim 13, wherein the main body and the restriction body are mounted in a case in cooperation with a metal leaf spring.

16. The conductive component structure of wire connection terminal as claimed in claim 15, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

17. The conductive component structure of wire connection terminal as claimed in claim 15, wherein the oblique wall of the restriction body includes two lateral oblique walls and an upper oblique wall, the two lateral oblique walls being connected with the door plate and obliquely extending in a direction away from the door plate to respectively form a free end, the free ends being gradually converged to get closer to each other to form a holding opening, the upper oblique wall being connected with the door plate and obliquely extending in a direction away from the door plate and toward the main body to form a rear end section, the restriction body having a hardness greater than a hardness of the main body, two end sections of the main body being formed with bent edges upward extending from the lateral sides of the main body, whereby the two end sections of the main body are formed as a structure with a U-shaped cross section.

18. The conductive component structure of wire connection terminal as claimed in claim 17, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

19. The conductive component structure of wire connection terminal as claimed in claim 13, wherein the lateral sides of the main body are formed with insertion notches and the door plate is a reverse U-shaped structure.

20. The conductive component structure of wire connection terminal as claimed in claim 19, wherein the oblique wall of the restriction body includes two lateral oblique walls and an upper oblique wall, the two lateral oblique walls being connected with the mouth section and obliquely extending in a direction away from the mouth section to respectively form a free end, the free ends being gradually converged to get closer to each other to form a holding opening, the upper oblique wall being connected with the mouth section and obliquely extending in a direction away from the mouth section and toward the main body to form a rear end section, the restriction body having a hardness greater than a hardness of the main body, two end sections of the main body being formed with bent edges upward extending from the lateral sides of the main body, whereby the two end sections of the main body are formed as a structure with a U-shaped cross section.

21. The conductive component structure of wire connection terminal as claimed in claim 19, wherein the main body and the restriction body are mounted in a case in cooperation with a metal leaf spring.

22. The conductive component structure of wire connection terminal as claimed in claim 21, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

23. The conductive component structure of wire connection terminal as claimed in claim 21, wherein the oblique wall of the restriction body includes two lateral oblique walls and an upper oblique wall, the two lateral oblique walls being connected with the door plate and obliquely extending in a direction away from the door plate to respectively form a free end, the free ends being gradually converged to get closer to each other to form a holding opening, the upper oblique wall being connected with the door plate and obliquely extending in a direction away from the door plate and toward the main body to form a rear end section, the restriction body having a hardness greater than a hardness of the main body, two end sections of the main body being formed with bent edges upward extending from the lateral sides of the main body, whereby the two end sections of the main body are formed as a structure with a U-shaped cross section.

24. The conductive component structure of wire connection terminal as claimed in claim 23, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

25. The conductive component structure of wire connection terminal as claimed in claim 13, wherein the door plate of the restriction body has bent leg sections securely connected with the bottom side of the main body, and the main body and the restriction body are mounted in a case in cooperation with a metal leaf spring.

26. The conductive component structure of wire connection terminal as claimed in claim 25, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

27. The conductive component structure of wire connection terminal as claimed in claim 25, wherein the oblique wall of the restriction body includes two lateral oblique walls and an upper oblique wall, the two lateral oblique walls being connected with the door plate and obliquely extending in a direction away from the door plate to respectively form a free end, the free ends being gradually converged to get closer to each other to form a holding opening, the upper oblique wall having a rear end section and a subsidiary end section, the subsidiary end section being connected with the door plate, the rear end section obliquely extending in a direction away from the door plate and toward the main body.

28. The conductive component structure of wire connection terminal as claimed in claim 27, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

29. The conductive component structure of wire connection terminal as claimed in claim 27, wherein the conductive component has two restriction bodies and a base section is connected between the rear end sections of the upper oblique walls of the two restriction bodies, the base section being overlaid on the main body.

30. The conductive component structure of wire connection terminal as claimed in claim 29, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

31. The conductive component structure of wire connection terminal as claimed in claim 29, wherein the upper oblique walls, the base section and the main body are made of the same electro-conductive material, the door plates and the lateral oblique walls of the restriction bodies having a hardness greater than a hardness of the main body.

32. The conductive component structure of wire connection terminal as claimed in claim 31, wherein the metal leaf spring includes a first leaf spring and a second leaf spring, each of the first and second leaf springs having a head section, a bight section connected with the head section and a tail section connected with the bight section, a length of the tail section of the first leaf spring being smaller than a length of the tail section of the second leaf spring, the tail sections of the first and second leaf springs being respectively formed with a bent section, a contained angle of the bent section of the tail section of the first leaf spring being equal to or different from a contained angle of the bent section of the tail section of the second leaf spring, the metal leaf spring being mounted on a stake of the case, the head section and the bight section of the first leaf spring being overlaid on the head section and the bight section of the second leaf spring, while the tail section of the first leaf spring being separated from the tail section of the second leaf spring, the tail section of the second leaf spring partially extending into the restriction body, the tail section of the first leaf spring and the tail section of the second leaf spring respectively forming a pressing point against the conductive wire, whereby the oblique wall of the restriction body cooperates with the first and second leaf springs to press and restrict the conductive wire.

* * * * *